US008154482B2

(12) United States Patent
Lee et al.

(10) Patent No.: US 8,154,482 B2
(45) Date of Patent: Apr. 10, 2012

(54) ORGANIC LIGHT EMITTING DISPLAY AND METHOD FOR DRIVING THE SAME

(75) Inventors: Wook Lee, Yongin (KR); Sung-Cheon Park, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 564 days.

(21) Appl. No.: 12/463,287

(22) Filed: May 8, 2009

(65) Prior Publication Data

US 2009/0278772 A1 Nov. 12, 2009

(30) Foreign Application Priority Data

May 9, 2008 (KR) ..... 10-2008-0043175

(51) Int. Cl.
*G09G 3/30* (2006.01)

(52) U.S. Cl. ..... 345/77; 345/82

(58) Field of Classification Search ..... 345/76, 345/77, 82, 83, 87–100, 204, 690
See application file for complete search history.

(56) References Cited

U.S. PATENT DOCUMENTS

| | | | | |
|---|---|---|---|---|
| 5,844,533 | A * | 12/1998 | Usui et al. | 345/89 |
| 2002/0109791 | A1* | 8/2002 | Champion | 348/714 |
| 2006/0152452 | A1 | 7/2006 | Hoppenbrouwers et al. | |
| 2006/0221014 | A1 | 10/2006 | Park et al. | |
| 2006/0262109 | A1 | 11/2006 | Park et al. | |
| 2007/0103410 | A1 | 5/2007 | Oh | |
| 2007/0132747 | A1* | 6/2007 | Endo | 345/204 |
| 2007/0146394 | A1* | 6/2007 | Ahn | 345/690 |
| 2008/0246699 | A1 | 10/2008 | Oh | |

FOREIGN PATENT DOCUMENTS

| | | |
|---|---|---|
| CN | 1816839 A | 8/2006 |
| CN | 1841478 A | 10/2006 |
| JP | 06-309241 | 11/1994 |
| JP | 8-298630 | 11/1996 |
| JP | 11-338419 | 12/1999 |
| JP | 2003-228328 | 8/2003 |
| JP | 2005-070426 | 3/2005 |

(Continued)

OTHER PUBLICATIONS

Korean Office Action, Application No. 10-2008-0043175, dated Nov. 26, 2009.

European Search Report dated Jul. 23, 2010, for corresponding European Patent application 09159860.7, noting listed reference in this IDS, as well as U.S. Publications 2006/0152452 and 2006/0262109, previously filed in an IDS dated Oct. 16, 2009.

(Continued)

*Primary Examiner* — Kevin M Nguyen
(74) *Attorney, Agent, or Firm* — Christie, Parker & Hale, LLP

(57) ABSTRACT

An organic light emitting display and a method for driving the same. An organic light emitting display includes: a frame memory having a first portion configured to store a first portion of image signals that is the same in an n−1$^{th}$ frame and an n$^{th}$ frame, and a second portion configured to store a second portion of the image signals that is different in the n−1$^{th}$ frame and the n$^{th}$ frame; a storing unit for storing the first portion of the image signals; a luminance controller for summing the second portion of the image signals and the first portion of the image signals stored in the storing unit to generate a frame data; and a scan driver for supplying light emitting control signals with a controlled pulse width according to a magnitude of the frame data.

11 Claims, 5 Drawing Sheets

FOREIGN PATENT DOCUMENTS

| | | | |
|---|---|---|---|
| JP | 2005-084540 | | 3/2005 |
| JP | 2005-301095 | | 10/2005 |
| JP | 2006-038967 | | 2/2006 |
| JP | 2006-285235 | | 10/2006 |
| JP | 2006-285236 | | 10/2006 |
| JP | 2007-147731 | | 6/2007 |
| JP | 2007-147867 | | 6/2007 |
| KR | 1020040087400 | A | 10/2004 |
| KR | 1020050032321 | A | 4/2005 |
| KR | 10-2005-0112654 | | 12/2005 |
| KR | 1020060112998 | A | 11/2006 |
| KR | 1020070049908 | A | 5/2007 |

OTHER PUBLICATIONS

Chinese Office action dated Aug. 11, 2011 issued to Patent Application No. 200910139301.1, which claims priority to corresponding Korean priority application No. 10-2008-0043175.

Japanese Office Action, dated Jun. 28, 2011 corresponding to Japanese Patent Application No. 2008-230918, 4 pages.

European Search Report dated Aug. 7, 2009, for correponding European application 09159860.7, noting listed references in this IDS.

* cited by examiner

ORGANIC LIGHT EMITTING DISPLAY AND METHOD FOR DRIVING THE SAME

CROSS-REFERENCE TO RELATED APPLICATIONS

This application claims priority to and the benefit of Korean Patent Application No. 10-2008-0043175, filed on May 9, 2008, in the Korean Intellectual Property Office, the entire content of which is incorporated herein by reference.

BACKGROUND OF THE INVENTION

1. Field of the Invention

The present invention relates to an organic light emitting display and a method for driving the same.

2. Description of Related Art

Recently, various flat panel display devices with reduced weight and volume in comparison to a cathode ray tube display device have been developed. Among the flat panel display devices, there are a liquid crystal display (LCD), a field emission display (FED), a plasma display panel (PDP), an organic light emitting display, etc.

An organic light emitting display displays an image by using organic light emitting diodes (OLEDs) to generate light by the recombination of electrons and holes.

The organic light emitting display as described above has an excellent color reproducibility, a thin thickness, etc. so that its market has been largely expanded to a variety of applications such as applications in a PDA, an MP3 player, a cellular phone, etc.

An organic light emitting diode, which is included in an organic light emitting display, includes an anode electrode, a cathode electrode and a light emitting layer positioned therebetween. When current flows in a direction from the anode electrode to the cathode electrode, the light emitting layer emits light. Different luminances may be displayed by changing the amount of light emitted by varying the amount of current flowing from the anode electrode to the cathode electrode.

FIG. 1 is a schematic block diagram showing a conventional organic light emitting display. Referring to FIG. 1, the organic light emitting display includes a display unit 10, a data driver 20, a scan driver 30, and a power supply unit 40.

The display unit 10 includes a plurality of pixels 11 each including an organic light emitting diode (not shown). A plurality of n scan lines (S1,S2, . . . Sn−1, and Sn) extend in a row direction for transferring scan signals, a plurality of m data lines (D1,D2, . . . Dm−1, and Dm) extend in a column direction for transferring data signals, a plurality of m first power supply lines (not shown) for transferring a first power ELVDD, and a plurality of m second power supply lines (not shown) for transferring a second power ELVSS that has a lower potential than the first power ELVDD. The display unit 10 displays images by utilizing the organic light emitting diodes to emit light in response to the scan signals, the data signals, the first power ELVDD, and the second power ELVSS.

The data driver 20 applies the data signals to the display unit 10 through the data lines (D1, D2, . . . Dm−1, and Dm) that are coupled to the display unit 10.

The scan driver 30 sequentially outputs the scan signals to the scan lines (S1, S2, . . . , Sn−1, and Sn) to transfer the scan signals to a corresponding row of pixels 11 of the display unit 10. The row of pixels 11 of the display unit 10 receiving the scan signal are applied with the data signals from the data driver 20 to display the image, wherein all columns are sequentially selected so that one frame is completed.

The power supply unit 40 transfers the first power ELVDD and the second power ELVSS that has a lower potential than the first power ELVDD to the display unit 10 to supply a current corresponding to the data signals applied to the pixels 11 according to the voltage difference between the first power ELVDD and the second power ELVSS.

The organic light emitting display configured as described above allows a large amount of current to flow in the display unit 10 when displaying an image with a high luminance and a small amount of current to flow therein when displaying an image with a low luminance. When the large amount of current flows in the display unit 10 to display the image with a high luminance, a significant load is applied to the power supply unit 40 so that the power supply unit 40 should be capable of a high output current.

SUMMARY OF THE INVENTION

Embodiments of the present invention provide an organic light emitting display and a method for driving the same capable of reducing power consumption and improving image quality.

According to an embodiment of the present invention, an organic light emitting display includes: a display unit having a plurality of pixels for displaying images corresponding to image signals in response to a plurality of scan signals, a plurality of light emitting control signals, and a plurality of data signals; a frame memory having a first portion for storing a first portion of the image signals that is the same in an $n-1^{th}$ frame and an $n^{th}$ frame and a second portion for storing a second portion of the image signals that is different between the $n-1^{th}$ frame and the $n^{th}$ frame; a storing unit for storing the first portion of the image signals of the $n-1^{th}$ frame; a luminance controller for summing the second portion of the image signals and the first portion of the image signals stored in the storing unit to generate frame data; a scan driver for supplying the scan signals and the light emitting control signals with a controlled pulse width according to a magnitude of the frame data to the display unit; and a data driver for generating the plurality of data signals by utilizing the image signals stored in the frame memory and supplying the data signals to the display unit.

According to another embodiment of the present invention, a method is provided for driving an organic light emitting display having a display unit for displaying images corresponding to image signals in response to data signals, scan signals, and light emitting control signals. The method includes: storing a first portion of the image signals that is the same in an $n-1^{th}$ frame and an $n^{th}$ frame; generating first frame data by summing the first portion of the image signals; generating second frame data by summing a second portion of the image signals that is different between the $n-1^{th}$ frame and the $n^{th}$ frame; and controlling pulse widths of the light emitting control signals corresponding to a summed result of the first frame data and the second frame data.

According to yet another embodiment of the present invention, an organic light emitting display includes: a frame memory having a first portion for storing a first portion of image signals that is the same in an $n-1^{th}$ frame and an $n^{th}$ frame, and a second portion for storing a second portion of the image signals that is different between the $n-1^{th}$ frame and the $n^{th}$ frame; a storing unit for storing the first portion of the image signals; a luminance controller for summing the second portion of the image signals and the first portion of the image signals stored in the storing unit to generate frame data;

and a scan driver for supplying light emitting control signals with a controlled pulse width according to a magnitude of the frame data.

An organic light emitting display according to the embodiments of the present invention may reduce power consumption and improve image quality.

BRIEF DESCRIPTION OF THE DRAWINGS

The accompanying drawings, together with the specification, illustrate exemplary embodiments of the present invention, and, together with the description, serve to explain the principles of the exemplary embodiments of the present invention.

DETAILED DESCRIPTION OF EXEMPLARY EMBODIMENTS

Figure 1:
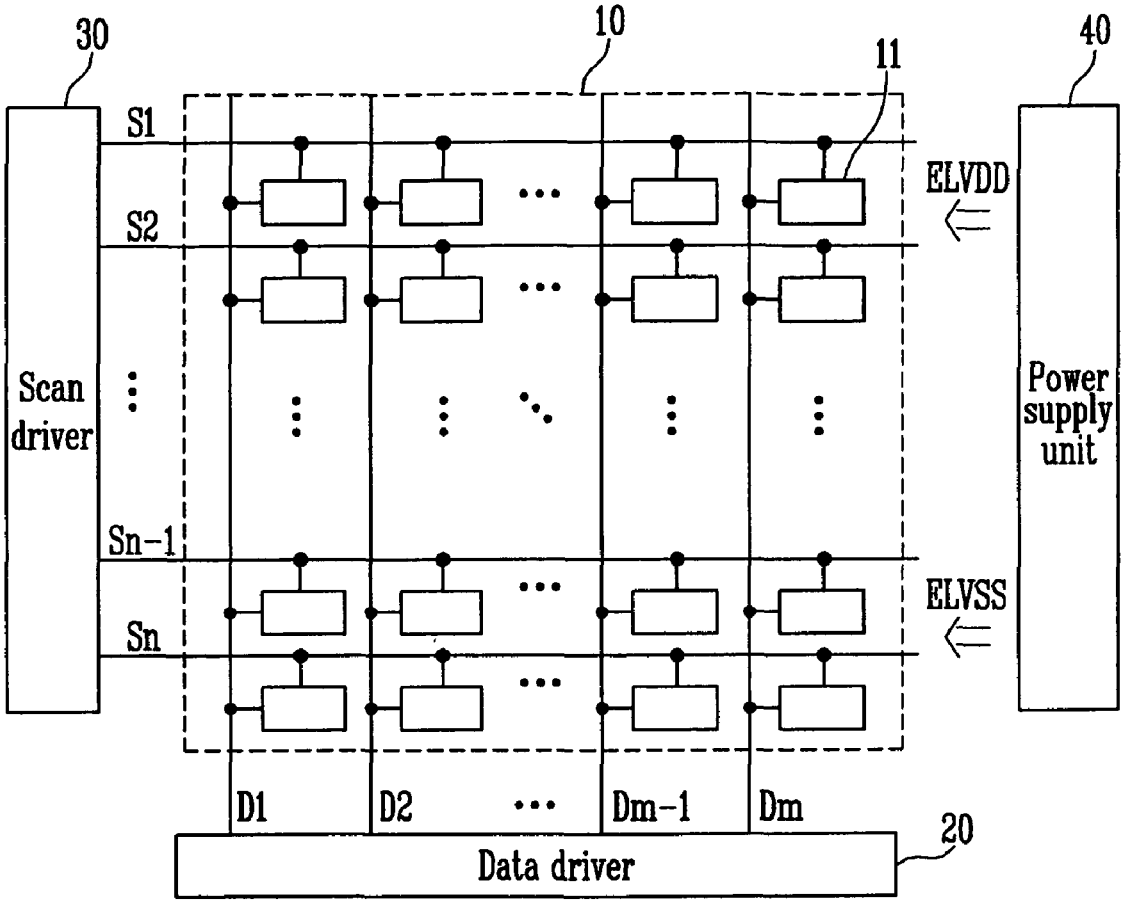
FIG. 1 is a schematic block diagram of a conventional organic light emitting display.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the present invention are omitted for clarity. Also, like reference numerals refer to like elements throughout.

Hereinafter, certain exemplary embodiments according to the present invention will be described with reference to the accompanying drawings.

Figure 2:
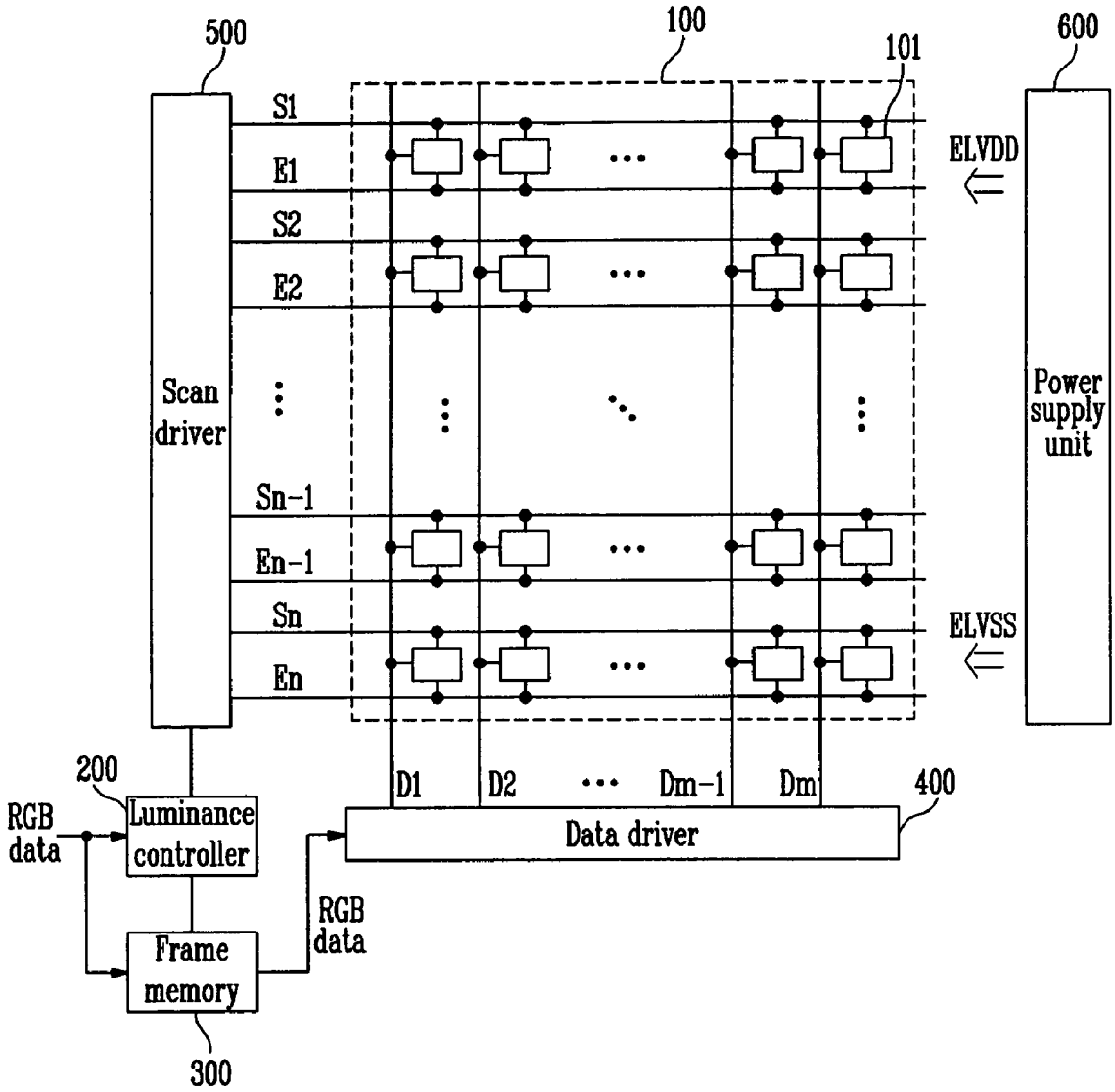
FIG. 2 is a schematic block diagram of an organic light emitting display according to an embodiment of the present invention.

FIG. 2 is a schematic block diagram of an organic light emitting display according to an embodiment of the present invention. Referring to FIG. 2, the organic light emitting display includes a display unit 100, a luminance controller 200, a frame memory 300, a data driver 400, a scan driver 500, and a power supply unit 600.

The display unit 100 includes a plurality of pixels 101 each including an organic light emitting diode (not shown). A plurality of n scan lines (S1, S2, . . . Sn−1, and Sn) extend in a row direction for transferring scan signals. A plurality of n light emitting control lines (E1, E2, . . . En−1, and En) extend in the row direction. A plurality of m data lines (D1, D2, . . . Dm−1, and Dm) extend in a column direction for transferring data signals. First power supply lines (not shown) transfer a first power ELVDD to the pixels 101, and second power supply lines (not shown) transfer a second power ELVSS to the pixels 101.

The luminance controller 200 outputs a luminance control signal Ic to limit luminance so that the luminance of the display unit 100 while displaying images does not exceed a suitable level (e.g., a predetermined level). The luminance of the display unit 100 is higher when a large number of the pixels 101 emit light at a high luminance than when a small number of the pixels 101 emit light at a high luminance. For example, when the pixels 101 of the display unit 100 emits light of a full white color, the display unit 100 has a luminance higher than in other cases. Therefore, when an area that is emitting light at a higher luminance as described above is large, power consumption is high. Therefore, in order to reduce the power consumption, the luminance should be lowered to a suitable level (e.g., a predetermined level). Here, the luminance is varied according to the number of pixels 101 that are emitting light at a high luminance by changing a range limiting luminance according to the area that is emitting light at the high luminance.

The luminance controller 200 determines the magnitude of frame data, which is a sum of image signals (e.g., RGB data) input in one frame, to determine (or to judge) that a large amount of current flows in the display unit 100 due to a large number of pixels 101 emitting light at a high luminance when the magnitude of the frame data is large, or that a small amount of current flows in the display unit 100 due to a small number of pixels 101 emitting light at a high luminance when the magnitude of the frame data is small. Therefore, the luminance controller 200 outputs the luminance control signal Ic to limit luminance corresponding to the magnitude of the frame data.

When the luminance of the display unit 100 is limited by the luminance controller 200, the amount of current flowing in the display unit 100 is limited so that a high-output power supply unit 600 is not needed. When the luminance of the display unit 100 is not limited, the light emitting time of the light emitting pixels is maintained to be long so that the luminance is increased. Therefore, the contrast ratio of the light emitting pixel 101 to the non-light emitting pixel 101 is large. Therefore, the contrast ratio of the pixels is improved.

In a method of reducing the amount of current flowing in the display unit 100 according to an embodiment of the present invention, the time for supplying current is reduced by reducing the light emitting time of the pixels 101, thereby making it possible to reduce the amount of current flowing in the display unit 100.

The luminance controller 200 controls the pulse width of the light emitting control signals transferred through the light emitting control signal lines (E1, E2, . . . En−1, En) in order to control the light emitting time of the display unit 100. The light emitting time of the display unit 100 is controlled according to the pulse width of the light emitting control signal, and the amount of current flowing in the display unit 100 is controlled accordingly.

The frame memory 300 stores image signals (RGB data) corresponding to one frame period to transfer the image signals (RGB data) to the data driver 400 in a frame unit.

The data driver 400, which applies the data signals to the display unit 100, receives the image signals (RGB data) to generate the data signals. The data driver 400 is coupled to the data lines (D1, D2, . . . , Dm−1, and Dm) of the display unit 100 to apply the generated data signals to the display unit 100.

The scan driver 500, which applies the scan signals and the light emitting control signals to the display unit 100, is coupled to the scan lines (S1, S2, . . . , Sn−1, and Sn) and the light emitting control signal lines (E1, E2, . . . , En−1, and En) to transfer the scan signals and the light emitting control signals to corresponding rows of the pixels 101. The pixels 101 applied with the scan signals receive the data signals output from the data driver 400, and the pixels 101 transferred with the light emitting control signals emit light according to the light emitting control signals.

The scan driver 500 may include a scan driving circuit for generating the scan signals and a light emitting driving circuit for generating the light emitting control signals. The scan driving circuit and the light emitting driving circuit may be included in one component and may be separated into individual components.

The row of the pixels 101 applied with the scan signals by the scan driver 500 receive the data signals input from the data driver 400, and currents corresponding to the data signals and the light emitting control signals flow through the corresponding organic light emitting diodes to emit light to display images. After all rows of pixels 101 are sequentially selected, one frame is completed.

The power supply unit 600 supplies the first power ELVDD and the second power ELVSS to the display unit 100 so that a current corresponding to the data signal flows through each one of the pixels 101 according to the voltage difference between the first power ELVDD and the second power ELVSS.

Figure 3A:
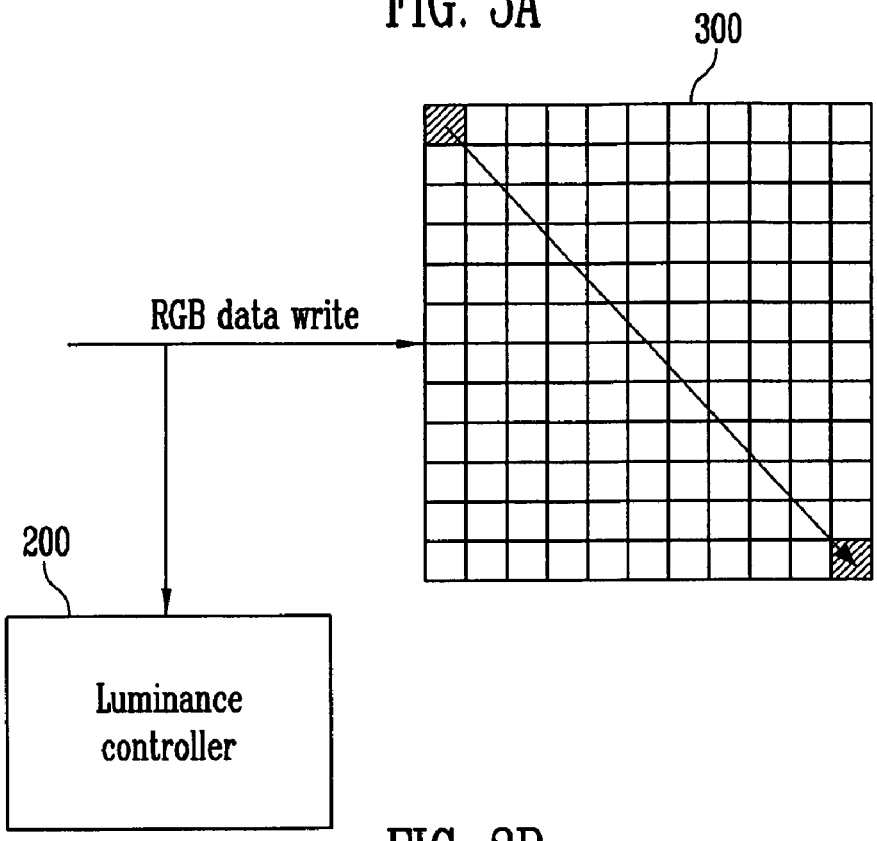
FIGS. 3A to 3C are schematic drawings showing a process of summing data of image signals in a luminance controller shown in FIG. 2.
Figure 3B:
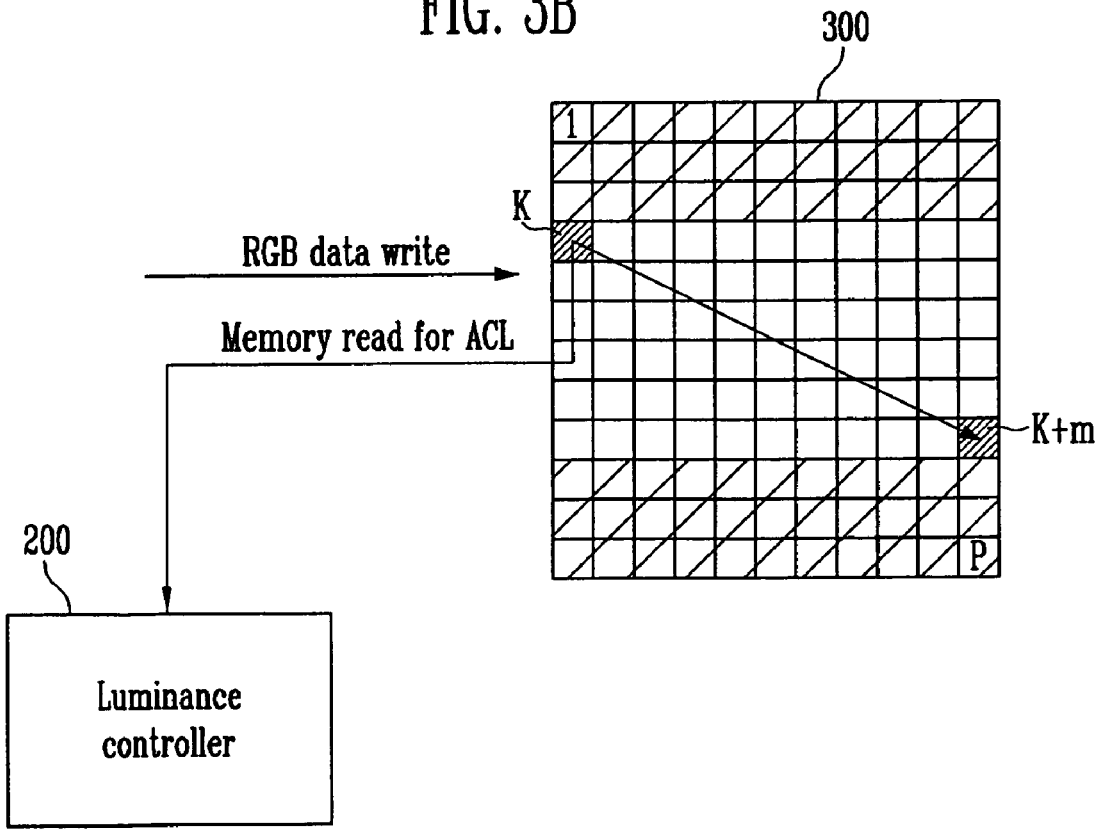
Figure 3C:
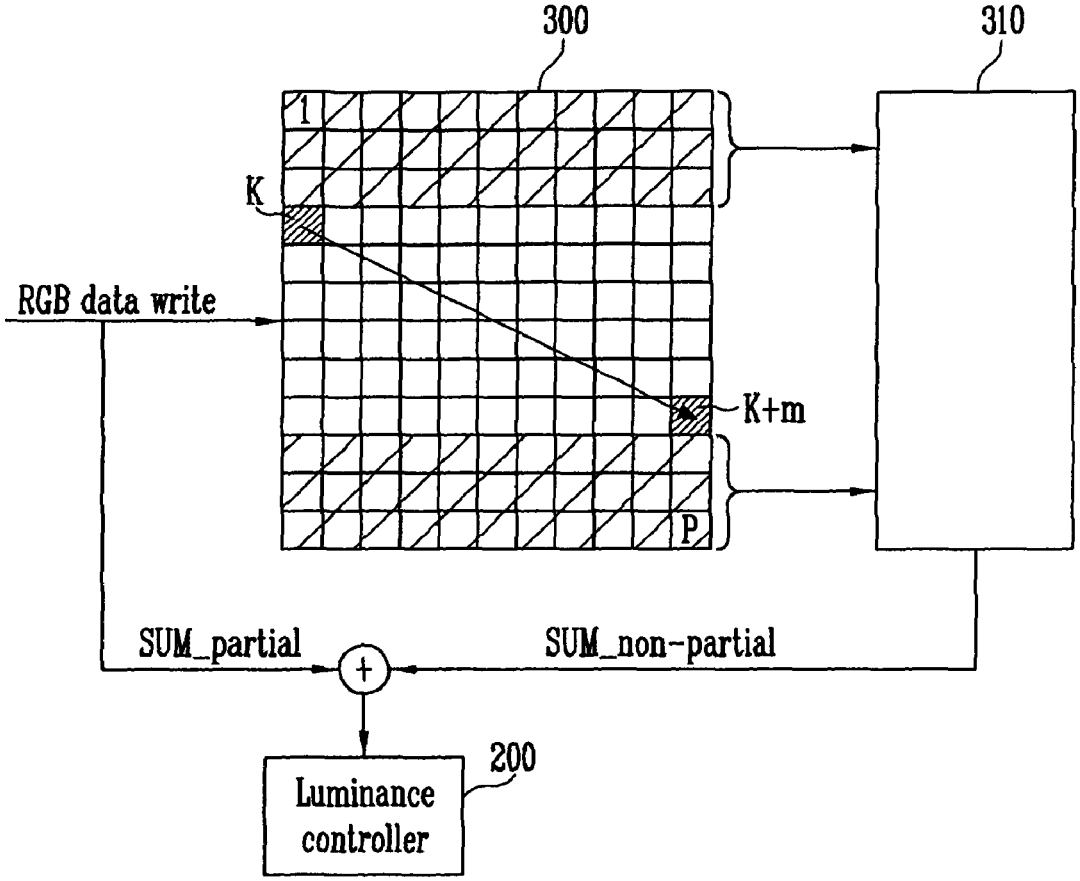

FIGS. 3A to 3C are schematic drawings showing a process of summing the data of the image signals (RGB data) in the luminance controller 200 shown in FIG. 2. FIG. 3A shows the case where the image signals (RGB data) to be stored in the entire frame memory 300 are updated per frame, FIG. 3B shows a first embodiment according to the present invention in which the image signals (RGB data) are stored to a portion of the frame memory 300, and FIG. 3C shows a second embodiment according to the present invention in which only a portion of the frame memory 300 is updated with newly received image signals (RGB data).

Referring to FIG. 3A, the luminance controller 200 receives and sums the image signals (RGB data) that are written to the frame memory 300, thereby generating the frame data per frame. Since the luminance controller 200 generates the frame data by summing the image signals (RGB data) per frame, the method shown in FIG. 3A can be applied to cases where the image signals (RGB data) constituting one entire frame are input.

When the input image signals (RGB data) correspond to only a portion of one frame, only a portion of a screen (e.g., the display unit 100) displays updated images, and the remaining portions display the same image from the last frame, as such, it is impossible to sum the image signals (RGB data) of one frame in a data summer.

Referring to FIG. 3B, all image signals (RGB data) displayed in one frame in an $n-1^{th}$ frame are transferred to the frame memory 300. Then, image signals corresponding to the different portions in an $n^{th}$ and the $n-1^{th}$ frames are input to the frame memory 300. In FIG. 3B, addresses of a portion of the frame memory 300 where the $n-1^{th}$ frame and the $n^{th}$ frame differ correspond to addresses k to k+m and addresses of a portion of the frame memory 300 where the $n-1^{th}$ frame is the same as the $n^{th}$ frame corresponds to addresses 1 to k−1 and addresses k+m+1 to p.

In FIG. 3B, the image signals corresponding to the addresses between k and k+m during the $n^{th}$ frame are transferred to the frame memory 300, and the remaining portions of the frame memory 300 store the corresponding portions of the image signals transferred during the $n-1^{th}$ frame. The image signals stored in the addresses between k and k+m in the $n-1^{th}$ frame are read from the frame memory 300 and compared to the image signals to be written in the addresses between k and k+m in the $n^{th}$ frame to generate comparison values.

The frame data of the $n^{th}$ frame is determined by utilizing the comparison values. For example, assuming that the frame data of the $n-1^{th}$ frame is 200, the sum of the corresponding image signals to be written in the addresses between k and k+m in the $n-1^{th}$ frame is 100, and the sum of the corresponding image signals to be written in the addresses between k and k+m in the $n^{th}$ frame is 90. The difference between the sum of the image signals to be written in the addresses between k and k+m in the $n-1^{th}$ frame and the sum of the image signals to be written in the address between k and k+m in the $n^{th}$ frame becomes 10. In other words, since the difference between the sums of the image signals in the changed portion is 10, the $n^{th}$ frame data is smaller by 10 than the $n-1^{th}$ frame data so that the frame data in the $n^{th}$ frame is 190.

Therefore, even when the image signals input in one frame corresponds to a portion of the frame, the frame data can be determined.

However, in order to determine the frame data, time is required for reading the image signals (RGB data) written in the addresses between k and k+m in the $n-1^{th}$ frame the $n^{th}$ frame. In other words, the image signals are read twice, therefore, the data processing speed may be delayed.

Referring to FIG. 3C, the image signals (RGB data) input to the addresses between 1 and k−1 and the addresses between k+m+1 and p of the frame memory 300 are the same in the $n-1^{th}$ frame and the $n^{th}$ frame, but the image signals input to the addresses between k and k+m in the $n-1^{th}$ frame are different from the image signals input to the addresses between k and k+m of the frame memory 300 in the $n^{th}$ frame. The image signals input to the addresses between 1 and k−1 and the addresses between k+m+1 and p of the $n-1^{th}$ frame are stored in a checksum block (or a storing block) 310 used for detecting errors.

The $n^{th}$ frame receives only the image signals (RGB data) to be stored at the addresses between k and k+m of the frame memory 300.

The luminance controller 200 sums the image signals (RGB data) written in the checksum block 310 and, at the same time, sums the image signals (RGB data) input to the addresses between k to k+m of the frame memory 300 to be written in the frame memory 300. The frame data is generated by utilizing the summed image signals.

Therefore, the image signals are not read twice unlike the example shown in FIG. 3B so that the data processing speed is not delayed.

Figure 4:
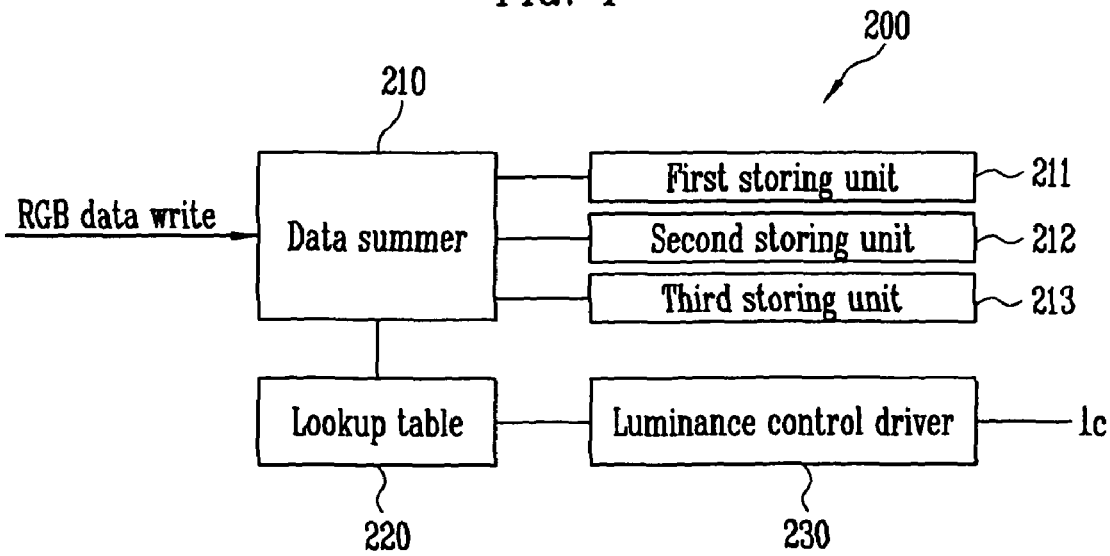
FIG. 4 is a schematic block diagram showing an exemplary luminance controller included in an organic light emitting display according to an embodiment of the present invention.

FIG. 4 is a schematic block diagram showing one example of a luminance controller included in an organic light emitting display according to an embodiment of the present invention. Referring to FIG. 4, the luminance controller 200 includes a data summer 210, a lookup table 220, and a luminance control driver 230.

The data summer 210 extracts information of the frame data by summing the image signals (RGB data) input to the frame memory 300. The frame data corresponds to a sum of all video data for one frame, wherein it would be appreciated that when the data value of the frame data is large, it includes many data corresponding to a high gray level, and when the data value of the frame data is small, it includes less data corresponding to a high gray level. The data summer 210 is coupled to a first storing unit 211 and a second storing unit 212. The first storing unit 211 stores the unchanged portion of the image signals (RGB data) in a partial driving, and the second storing unit 212 stores the changing portion of the image signals (RGB data) in a partial driving. Also, the data summer 210 is coupled to a third storing unit 213 for storing the sum of the portions of the image signals (RGB data) stored in the first storing unit 211 and the second storing unit 212 to store the frame data.

The lookup table 220 stores the width (or time duration) of the light emitting interval of the light emitting control signal according to the magnitude of the frame data stored in the third storing unit 213. The light emitting interval of the light emitting control signal stored in the lookup table 220 has a short length (or time duration) when the magnitude of the frame data is large and has a long length (or time duration) when the magnitude of the frame data is small. Also, when the magnitude of the frame data is below a suitable value (e.g., a predetermined value), the light emitting interval is set to be the longest to remove the luminance limitation as described above.

The luminance control driver 230 outputs the luminance control signal Ic corresponding to the length (or time duration) of the light emitting interval of the light emitting control signal stored in the lookup table 220. The luminance control signal Ic is input to the scan driver 500 to control the length (or time duration) of the light emitting interval of the light emitting control signal output from the scan driver 500. Therefore, the scan driver 500 outputs the light emitting control signal with the length (or time duration) of the light emitting interval determined according to the luminance control signal Ic. When the scan driver 500 includes a scan driving circuit and a light emitting control circuit, the luminance control signal Ic is input to the light emitting control circuit to output the light emitting control signals according to the luminance control signal Ic.

Figure 5:
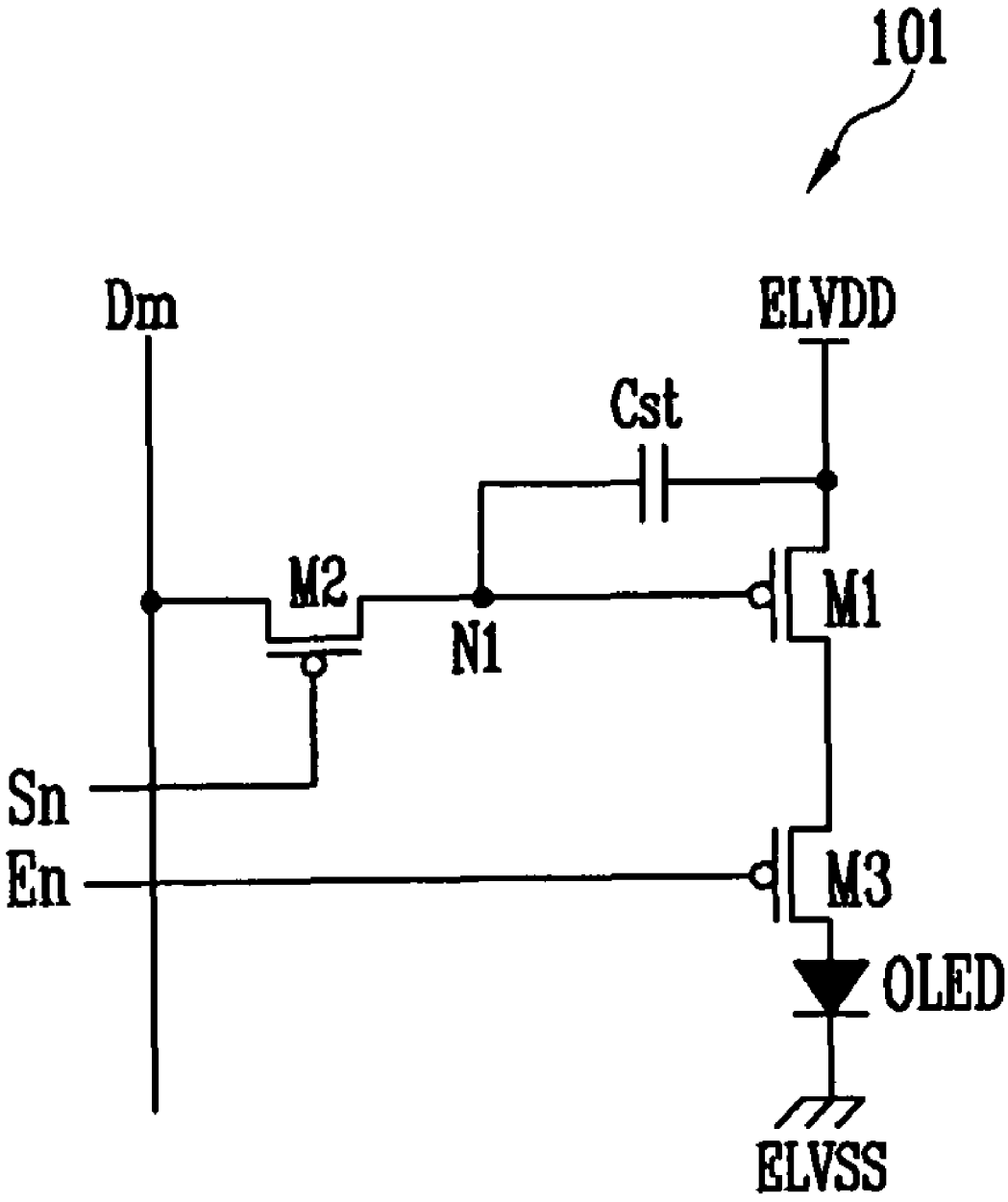
FIG. 5 is a schematic circuit diagram showing an exemplary pixel included in an organic light emitting display according to an embodiment of the present invention.

FIG. 5 is a schematic circuit diagram showing one example of a pixel of an organic light emitting display according to an embodiment of the present invention.

Referring to FIG. 5, the pixel 101 includes an OLED, a first transistor M1, a second transistor M2, a third transistor M3, and a capacitor Cst. The scan line Sn, the light emitting control line En, the data line Dm, and a power supply line for supplying the first power ELVDD are coupled to the pixel 101. The scan line Sn and the light emitting control line En extend in a row direction, and the data line Dm and the power supply line for supplying the first power ELVDD extend in a column direction.

A source of the first transistor M1 is coupled to the power supply line for supplying the first power ELVDD, a drain thereof is coupled to the OLED, and a gate thereof is coupled to a first node N1. A current for emitting light is supplied to the OLED according to the signal input to the gate of the first transistor M1. The amount of current flowing from the source of the first transistor M1 to the drain thereof is controlled by the data signal transferred to the first node N1 through the second transistor M2.

The source of the second transistor M2 is coupled to the data line Dm, the drain thereof is coupled to the first node N1, and the gate thereof is coupled to the scan line Sn to selectively transfer the data signal to the first node N1 according to the scan signals.

A first electrode of the capacitor Cst is coupled to the source of the first transistor M1, and a second electrode thereof is coupled to the first node N1 to maintain a voltage between the source and the gate of the first transistor M1 supplied by the data signal.

The source of the third transistor M3 is coupled to the drain of the first transistor M1, the drain thereof is coupled to the OLED, and the gate thereof is coupled to the light emitting control line En. Therefore, on/off of the transistor M3 is controlled according to the light emitting control signal transferred through the light emitting control line En. The third transistor M3 selectively transfers the current from the first transistor M1 to the OLED.

With the above described configuration, when the second transistor M2 is turned-on by the scan signal applied to the gate of the second transistor M2, a voltage corresponding to the data signal is charged in the capacitor Cst. Since the voltage charged in the capacitor Cst is applied to the gate electrode of the first transistor M1, a current flows through the first transistor M1 from its source to its drain corresponding to the data signal. The current flowing from the source to the drain is selectively provided to the OLED through the third transistor M3 that is coupled to the drain of the transistor M1. Therefore, when the pulse width of the light emitting control signal is controlled, the time in which the third transistor M3 maintains the on state is controlled so that the amount of current flowing through the OLED is controlled. In other words, when the pulse width of the light emitting control signal is controlled, the luminance of the OLED can be controlled.

While the present invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalent thereof.

What is claimed is:

1. An organic light emitting display comprising:

a display unit having a plurality of pixels for displaying images corresponding to image signals in response to a plurality of scan signals, a plurality of light emitting control signals, and a plurality of data signals;

a frame memory having a first portion for storing a first portion of the image signals that is the same in an $n-1^{th}$ frame and an $n^{th}$ frame and a second portion for storing a second portion of the image signals that is different between the $n-1^{th}$ frame and the $n^{th}$ frame;

a storing unit for storing the first portion of the image signals of the $n-1^{th}$ frame;

a luminance controller for summing the second portion of the image signals and the first portion of the image signals stored in the storing unit to generate frame data;

a scan driver for supplying the scan signals and the light emitting control signals with a controlled pulse width according to a magnitude of the frame data to the display unit; and a data driver for generating the plurality of data signals by utilizing the image signals stored in the frame memory and supplying the data signals to the display unit.

2. The organic light emitting display as claimed in claim 1, wherein the luminance controller comprises:

a data summer comprising:

a first storing unit for summing a corresponding portion of the image signals stored in the storing unit to generate a first value, and storing the first value;

a second storing unit for summing another corresponding portion of the image signals that is not stored in the storing unit to generate a second value, and storing the second value; and a third storing unit for summing the first value and the second value to generate a frame value, and storing the frame value;

a lookup table for storing the pulse widths of the light emitting control signals corresponding to the frame value stored in the third storing unit; and a controller for generating control signals for controlling the light emitting control signals corresponding to the pulse widths of the light emitting control signals stored in the lookup table.

3. The organic light emitting display as claimed in claim 1, wherein a light emitting time of the display unit is controlled by the pulse widths of the light emitting control signals.

4. The organic light emitting display as claimed in claim 1, wherein the storing unit is a checksum block.

5. The organic light emitting display as claimed in claim 1, wherein only a portion of the display unit displays the images.

6. A method for driving an organic light emitting display having a display unit for displaying images corresponding to image signals in response to data signals, scan signals, and light emitting control signals, the method comprising:

storing a first portion of the image signals that is the same in an $n-1^{th}$ frame and an $n^{th}$ frame;

generating first frame data by summing the first portion of the image signals;

generating second frame data by summing a second portion of the image signals that is different between the $n-1^{th}$ frame and the $n^{th}$ frame; and controlling pulse widths of the light emitting control signals corresponding to a summed result of the first frame data and the second frame data.

7. The method as claimed in claim 6, wherein only a portion of the display unit displays the images.

8. The method as claimed in claim 6, wherein the first portion of the image signals is stored in a checksum block.

9. An organic light emitting display comprising:

a frame memory having a first portion for storing a first portion of image signals that is the same in an $n-1^{th}$ frame and an $n^{th}$ frame, and a second portion for storing a second portion of the image signals that is different between the $n-1^{th}$ frame and the $n^{th}$ frame;

a storing unit for storing the first portion of the image signals;

a luminance controller for summing the second portion of the image signals and the first portion of the image signals stored in the storing unit to generate frame data; and a scan driver for supplying light emitting control signals with a controlled pulse width according to a magnitude of the frame data.

10. The organic light emitting display as claimed in claim 9, wherein the luminance controller comprises:

a data summer for summing the image signals to generate a frame value; and a lookup table for storing pulse widths of the light emitting control signals corresponding to the frame value; and a controller for generating control signals for controlling the light emitting control signals corresponding to the pulse widths of the light emitting control signals stored in the lookup table.

11. The organic light emitting display as claimed in claim 10, wherein the data summer comprises:

a first storing unit for summing a corresponding portion of the image signals stored in said storing unit to generate a first value, and storing the first value;

a second storing unit for summing another corresponding portion of the image signals that is not stored in said storing unit to generate a second value, and storing the second value; and a third storing unit for summing the first value and the second value to generate the frame value, and storing the frame value.

* * * * *